US008800194B2

(12) United States Patent
Teetzel et al.

(10) Patent No.: US 8,800,194 B2
(45) Date of Patent: Aug. 12, 2014

(54) PARALLEL AXLE MOUNTING RAIL CLAMP

(71) Applicant: Wilcox Industries Corp., Newington, NH (US)

(72) Inventors: James W. Teetzel, York, ME (US); Nathaniel G. Wright, Rye, NH (US); Marc J. Celona, Dover, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 13/902,901

(22) Filed: May 27, 2013

(65) Prior Publication Data

US 2013/0318852 A1 Dec. 5, 2013

Related U.S. Application Data

(60) Provisional application No. 61/653,755, filed on May 31, 2012.

(51) Int. Cl.

| | |
|---|---|
| ***F41G 1/387*** | (2006.01) |
| ***F41C 27/00*** | (2006.01) |
| *F41G 11/00* | (2006.01) |

(52) U.S. Cl.

CPC ..... *F41C 27/00* (2013.01); *F41G 11/003* (2013.01)

USPC ..... 42/124

(58) Field of Classification Search

CPC ..... F41G 11/003

USPC ..... 42/124, 127, 125

See application file for complete search history.

(56) References Cited

U.S. PATENT DOCUMENTS

| | | | |
|---|---|---|---|
| 6,442,883 | B1 | 9/2002 | Waterman et al. |
| 6,922,934 | B1 | 8/2005 | Huan |
| 7,685,759 | B2 | 3/2010 | Teetzel |

*Primary Examiner* — Reginald Tillman, Jr.

(74) *Attorney, Agent, or Firm* — McLane, Graf, Raulerson & Middleton, Professional Association

(57) ABSTRACT

An improved clamping device and method for a weapon accessory rail of a type having an elongate mounting structure of generally T-shaped cross-sectional shape, such as a Picatinny mounting rail, is provided.

11 Claims, 6 Drawing Sheets

PARALLEL AXLE MOUNTING RAIL CLAMP

CROSS-REFERENCE TO RELATED APPLICATION

This application claims priority to U.S. provisional application No. 61/653,755, filed May 31, 2012. The aforementioned application is incorporated herein by reference in its entirety.

BACKGROUND

The present disclosure relates to a clamp device for attachment to firearm mounting rail system such as a so-called Picatinny or floating rail structure (e.g., as per standard MIL-STD-1913) of a type commonly attached to a military firearms for attaching optical scopes, thermal or laser sights, tactical flashlights, vertically extending handgrips, or other weapon-mounted accessories.

SUMMARY

A clamping device for a weapon accessory rail of a type having an elongate mounting structure of generally T-shaped cross-sectional shape comprises a mounting base having a first clamping surface engaging a mounting surface of the mounting structure, an outward facing surface opposite the first clamping surface for attaching an accessory device thereto, and a hook disposed on a first transverse side of the mounting surface. The hook is configured to engage a first transverse side of the mounting structure. A pressure plate is slidable with respect to the mounting base and is received between first and second arms. The first and second arms are axially spaced apart and extend from the mounting surface on a second transverse side of the mounting surface opposite the first transverse side of the mounting surface. A cam member has a lever attached to a cam body, the cam body pivotally mounted between the first and second arms. The cam body bears against the pressure plate to cause sliding movement of the pressure plate in response to pivoting movement of the lever. A locking tab is slidably attached to the pressure plate, and is slidable between a locked position and an unlocked position. The locking tab has a lip engaging the cam member to prevent pivoting movement of the cam body out of a clamped position when the locking tab is in the locked position.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENT

Figure 1:
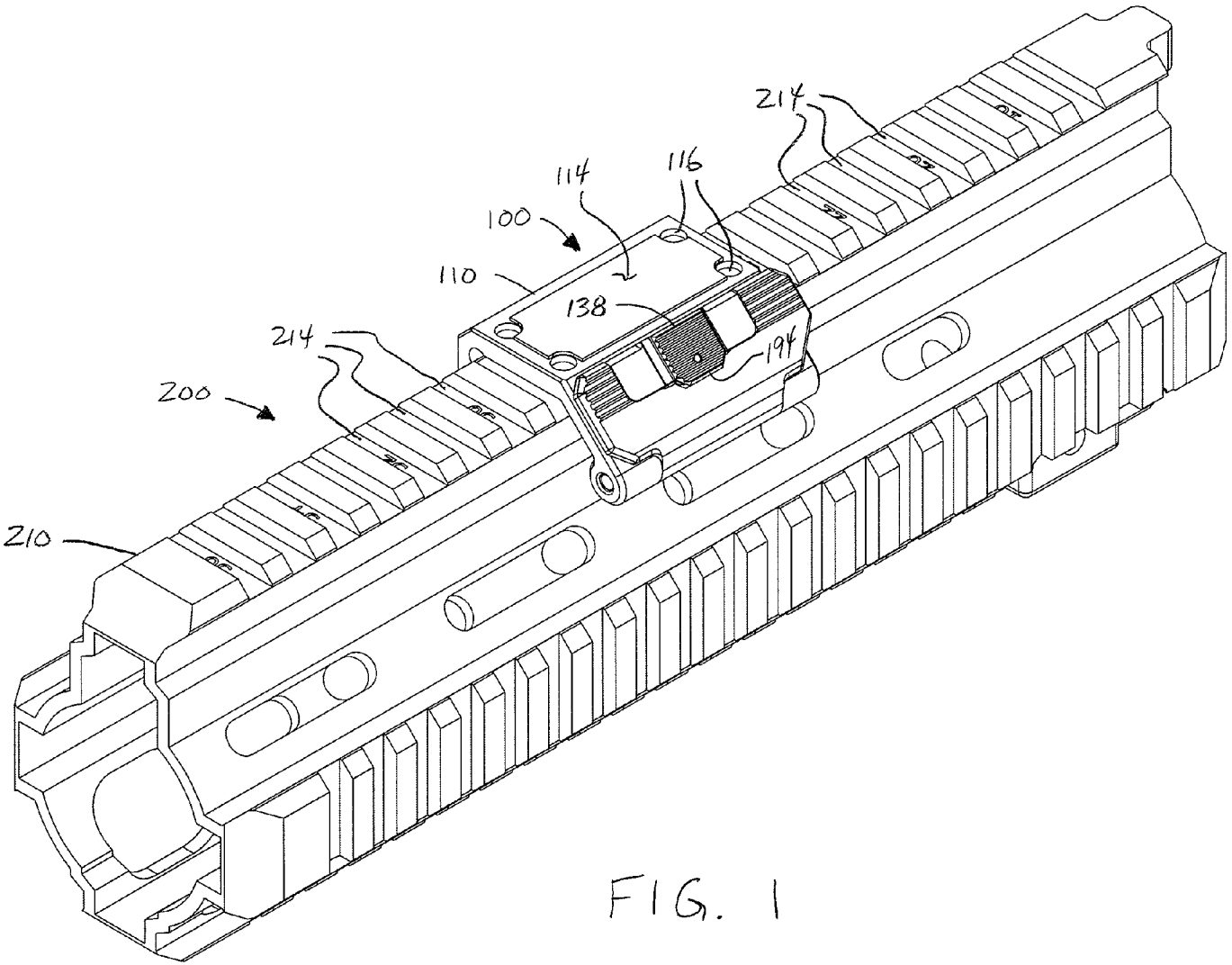
FIG. 1 is an isometric view of an exemplary embodiment rail clamp attached to a Picatinny rail.

Referring now to FIGS. 1, 2A-2D, and 3-6, an exemplary embodiment clamp in accordance with the present disclosure is shown, designated generally as 100, for removable attachment to a rail system 200 having one or more elongate mounting members 210. The rail clamp 100 includes a mounting base 110 and a movable pressure plate 112. The mounting base 110 includes an upper (in the orientation shown in FIG. 1) surface 114 having one or more apertures 116, which are preferably tapped or internally threaded openings for securing an accessory or device (not shown) to the surface 114 for removable mounting on the weapon rail interface 200 using the clamping member 100.

The mounting base 110 defines an axial channel 118 defined by a first inner surface 120 opposite the upper surface 114 for engaging the mounting member 210 when the unit 100 is attached to a weapon rail mounting system 200. The axial channel 118 is also defined by a second inner surface 122 for engaging a distal inclined surface 212*a* of the mounting member 210, which is in aligned and facing contacting relation when the unit 100 is attached to the mounting member 210.

In the depicted embodiment, a protruding member 124 may be provided on the inner surface 120, e.g., integrally formed or separately formed and attached via a threaded fastener, adhesive, or other fastening means. The protruding member 124 is sized to be received within a selected one of the grooves 214 to prevent axial movement of the clamping member 100 relative to the rail mounting member 210, e.g., due to recoil of the firearm when a round is fired.

The mounting base 110 includes a pair of arms 126, which are spaced apart in the axial direction and extend generally downward on the opposite transverse side of the mounting surface 114 as the second inner surface 122. The pressure plate 112 is slidably received between the arms 126, and is slidable in a direction orthogonal to a proximal inclined surface 212*b* of the mounting member 210. The pressure plate 112 includes a first, rail-engaging surface 128, which engages the proximal inclined surface 212*b* in aligned and facing contacting relation when the unit 100 is attached to a mounting member 210. The pressure plate 112 also includes a cam-engaging surface 132 opposite the rail engaging surface 128.

The pressure plate 112 includes a projection 132 having a pair of rails 134 defining a dovetail slot 136. A sliding, locking tab 138 is slidably received within the dovetail slot 136. Although the slot 136 and tab 138 are shown as having complimentary generally female and male dovetail shapes, respectively, it will be recognized that other geometries could be used in place of the dovetail slot, such as a T-slot, or any other complimentary geometric shape that provide for sliding retention of the tab 138.

Pressure plate retention pins 140 are received in openings 142 formed on the pressure plate. The pins 140 run along the interior surface of the arms 126 and prevent the pressure plate 112 from being disengaged from the unit 100, while allowing sliding movement of the pressure plate 112 relative to the arms 126 as it follows the cam surface, as will be described in greater detail below.

A pair of channels 144 is formed in the projection 132 between the rails 134. A spring 144 is captured within each channel 140. A pair of protrusions 148 is formed on the interior facing surface of the tab 138, aligned with and received in the channels 144. In operation, the springs 146 bear against the protrusions 148, urging the locking tab 138 generally downward (in the orientation shown in FIG. 5) and toward the locked position as shown in FIG. 1. The springs 146 may be coil springs, leaf springs or other resilient members. As will be discussed in greater detail below, manually sliding the tab 138 generally upward compresses the springs 146 and allows the unit 100 to be unlocked. A tab retention pin 150 retains the sliding tab 138 within the channel 136. The pin 150 extends through an opening 152 on the locking tab 138 and runs in an elongate opening 154 on the projection 132 to limit the extent of sliding movement.

A pressure plate height adjustment member 160 includes a bearing surface 162 abutting the surface 130 of the pressure plate. Extending from the height adjustment member opposite the bearing surface 162 is an externally threaded rod 164. An internally threaded nut 166, which is complimentary with the threaded rod 164, is rotatably received on the threaded rod 164.

A cam member 170 is rotatably secured to the mounting base 110. A pivot pin 172 passes through openings 174 in the arms 126 of the base member 110 and an opening 176 in the cam member 170 to allow the cam member 170 to pivot relative to the base member 110. The opening 176 is eccentrically positioned in the cam body 176. The cam member 170 includes tabs 178*a* and 178*b* to allow the user to manually rotate the cam member 170. A cam body 180 is disposed between the tabs 178*a* and 178*b*.

An upper recess 182 is formed in the upper (in the orientation shown in FIG. 6) surface of the cam member 170. The height adjustment member 160 is received within the upper recess 182 and the threaded rod 164 extends through openings 184 and 186. A central recess 188 is formed in the interior of the cam member 170. The nut 166 is received within the central recess 188. The nut 166 is rotatably received on the threaded rod 164 and an aperture 190 is provided to allow the user access to manually rotate the nut 164.

In this manner, rotation of the nut 166 in one direction causes the threaded rod to advance in one direction relative to the axis of the threaded rod 164, thus moving the height adjustment member 160 toward the pressure plate surface 130. Rotation of the nut 166 in the other direction causes the threaded rod 164 to axially retract, thus moving the height adjustment member 160 to move away from the pressure plate surface 130. By adjusting the position of the height adjustment member 160, the clamping pressure exerted when the unit 100 is secured to the rail member 210 can be adjusted. The threaded rod extends in a direction orthogonal to the proximal inclined surface 212*b*, thereby exerting a clamping pressure in a direction orthogonal to the surface 212*b*. This allows the unit 100 to better maintain its original orientation upon removal and reattachment than prior art devices that employ a transverse clamping force.

Figure 2D:
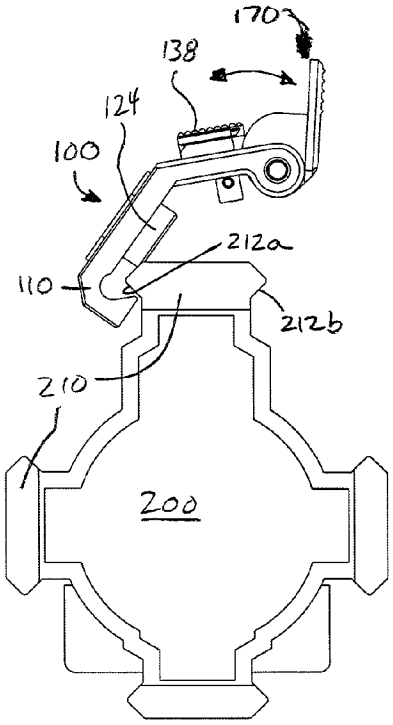
FIGS. 2A-2D are end views of the embodiment appearing in FIG. 1, and illustrate the manner of removing and attaching the rail clamp to the mounting rail.
Figure 2C:
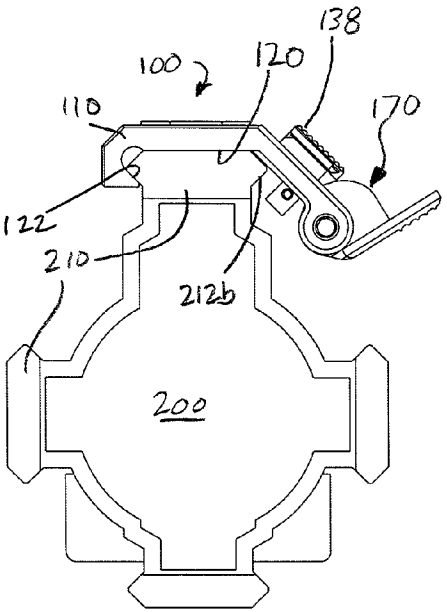
Figure 2B:
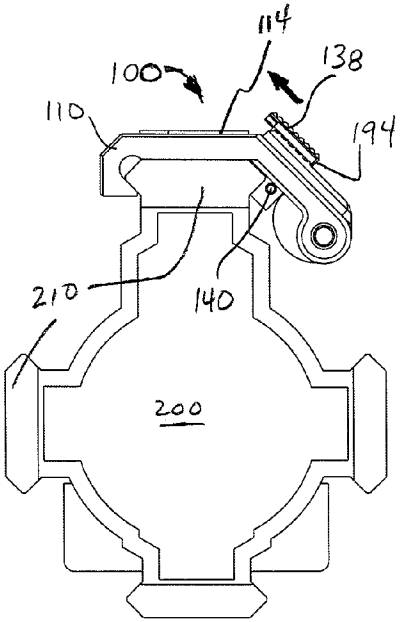
Figure 2A:
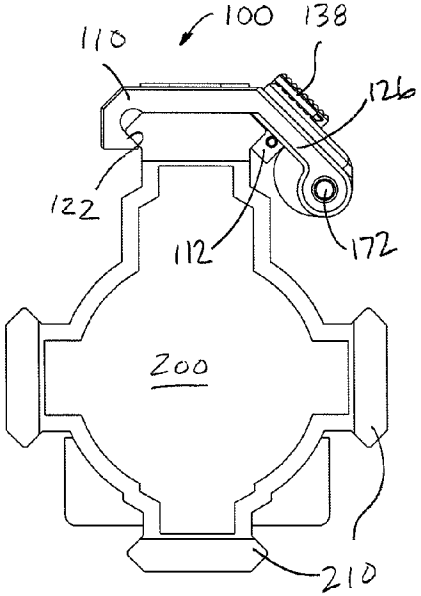
Figure 3:
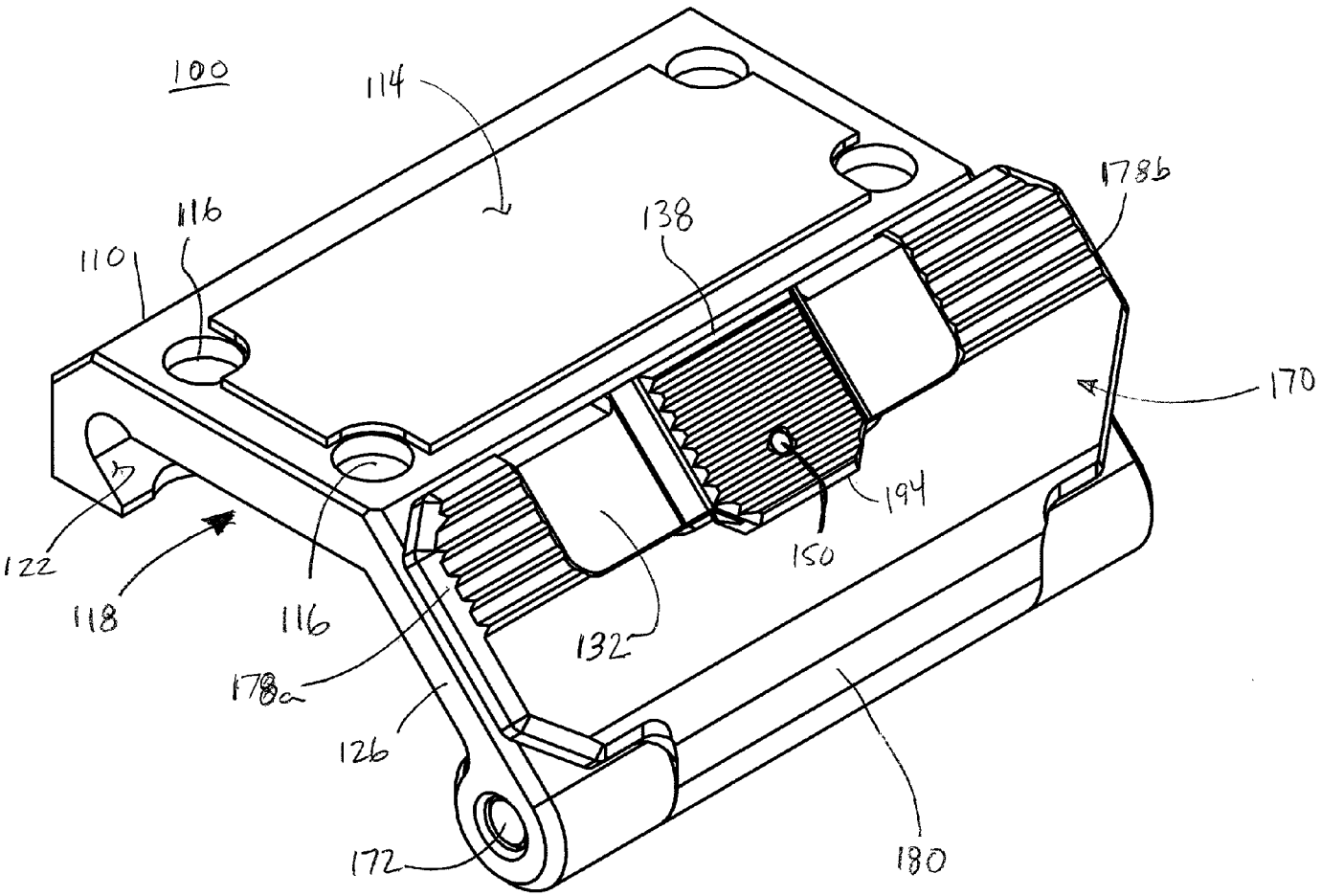
FIG. 3 is an enlarged top, isometric view of the rail clamp embodiment appearing in FIG. 1, shown in the locked position.

The cam body 180 of the cam member 170 has a generally curved surface and provides a camming action when the cam member 170 is rotated about the pivot axis 192, defined by the pivot pin 172, relative to the mount body 110, i.e., from the open position (see FIG. 2C) to the closed position (see FIG. 2A). The bearing surface 162 is likewise curved or tapered (e.g., in cross-sectional shape) and cooperates with the curved surface of the cam body 180 to define a cam surface of the cam body 180. The cam body 180 is eccentrically shaped (e.g., by off-center placement of the pivot axis 192 and pivot pin 172) such that the distance between the pivot axis 192 and the portion of the cam surface facing the surface 130 of the pressure plate 112 is greater when the cam member 170 is rotated to the closed position and less when the cam member 170 is rotated to the open position.

In operation, when the cam member 170 is pivoted to the closed position (see FIG. 2A), the springs 146 urge the tab 138 downward (in the orientation shown) such that a lip portion 194 of the tab 138 extends over the cam member 170, thereby preventing the operator from inadvertently rotating the cam member 170. In the event it is desired to remove the unit 100 from the rail member 210, the tab 138 is manually slid upward against the bias of the springs 146 until the lip 194 is clear of the cam member 170 (see FIG. 2B). A grooved or knurled surface or other high friction surface may be provided in the exterior facing surface of the tab 138 to assist the operator in sliding the tab 138.

Figure 4:
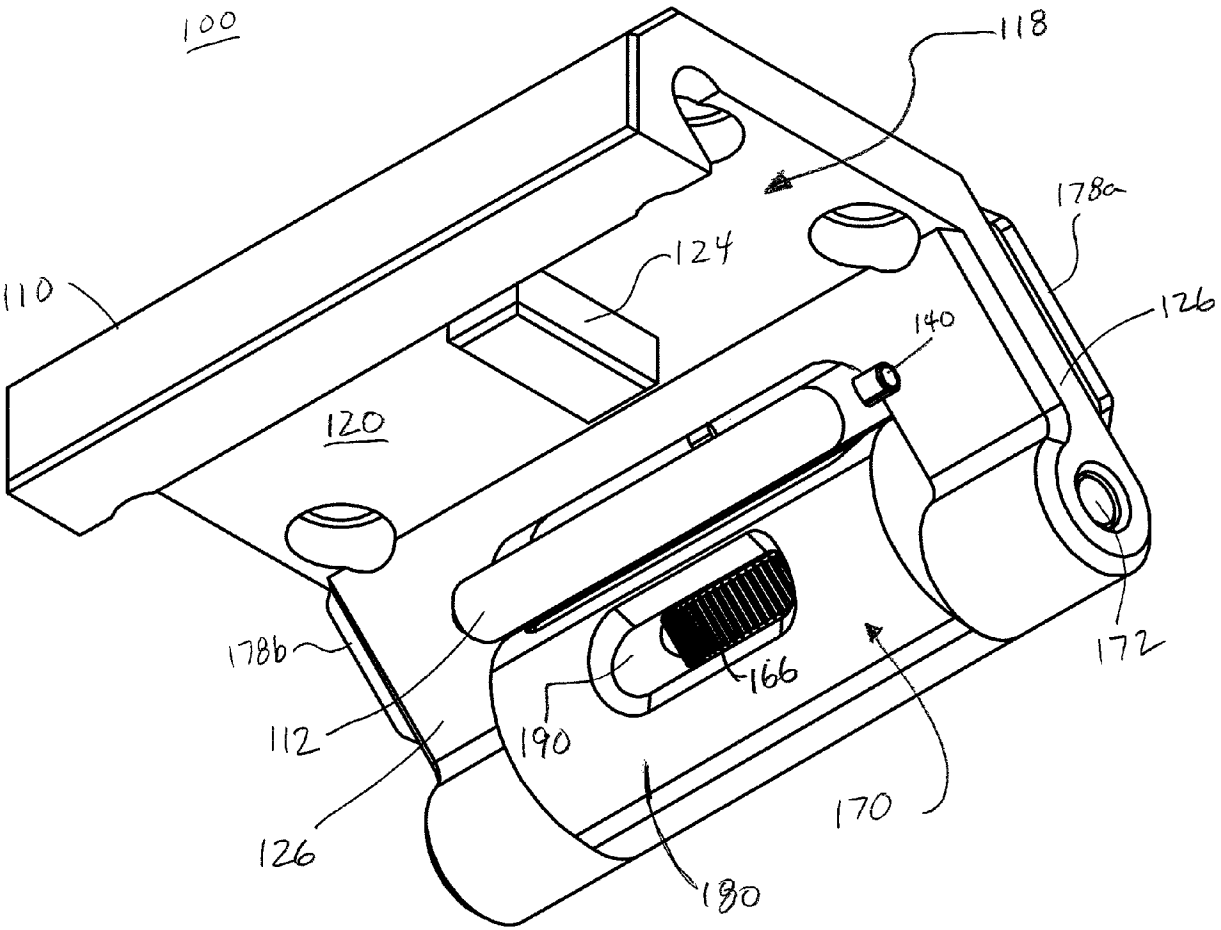
FIG. 4 is an enlarged bottom, isometric view of the rail clamp embodiment appearing in FIG. 1 in the locked position.
Figure 5:
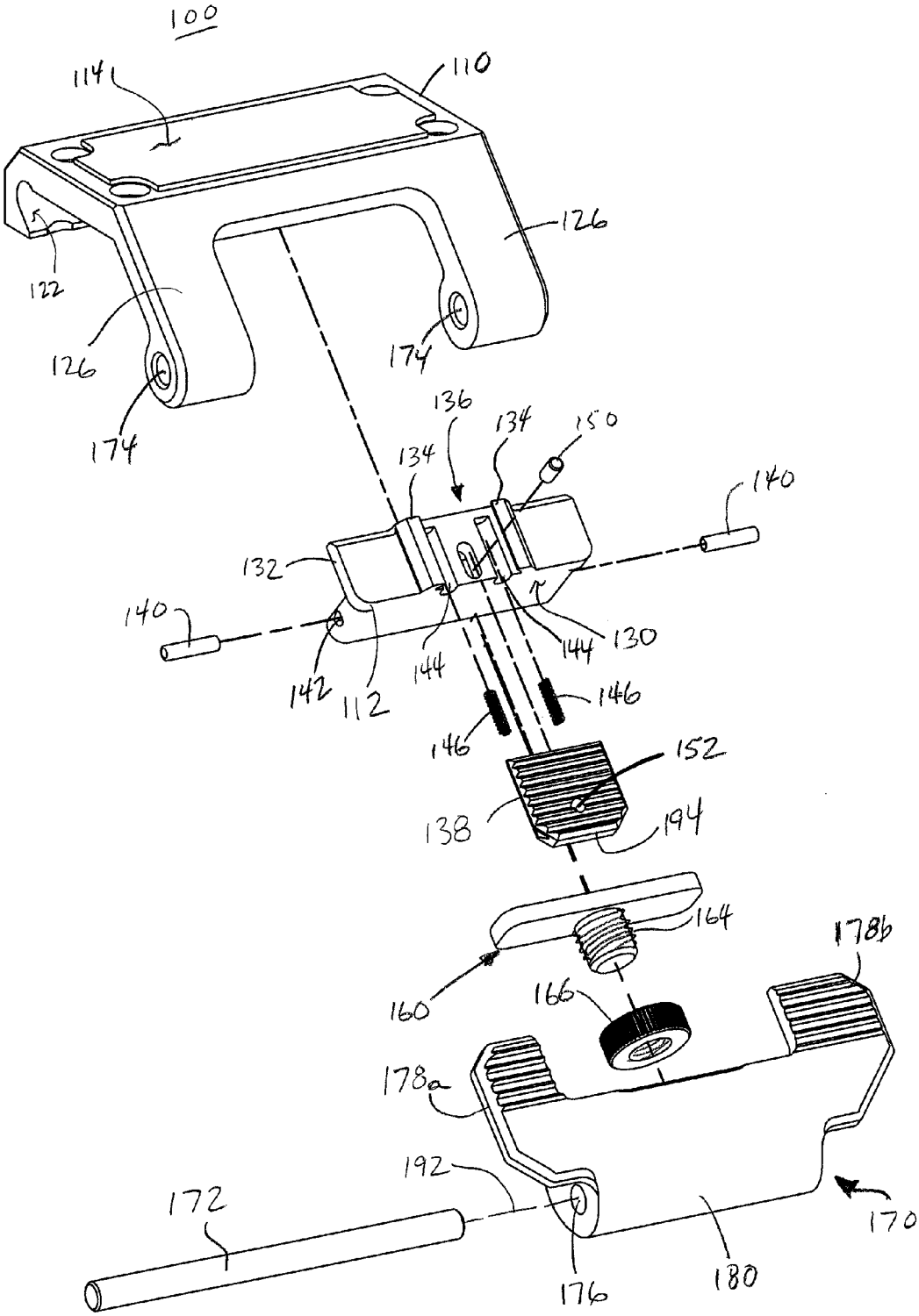
FIG. 5 is a generally exterior facing exploded view of the clamp embodiment appearing in FIG. 1.
Figure 6:
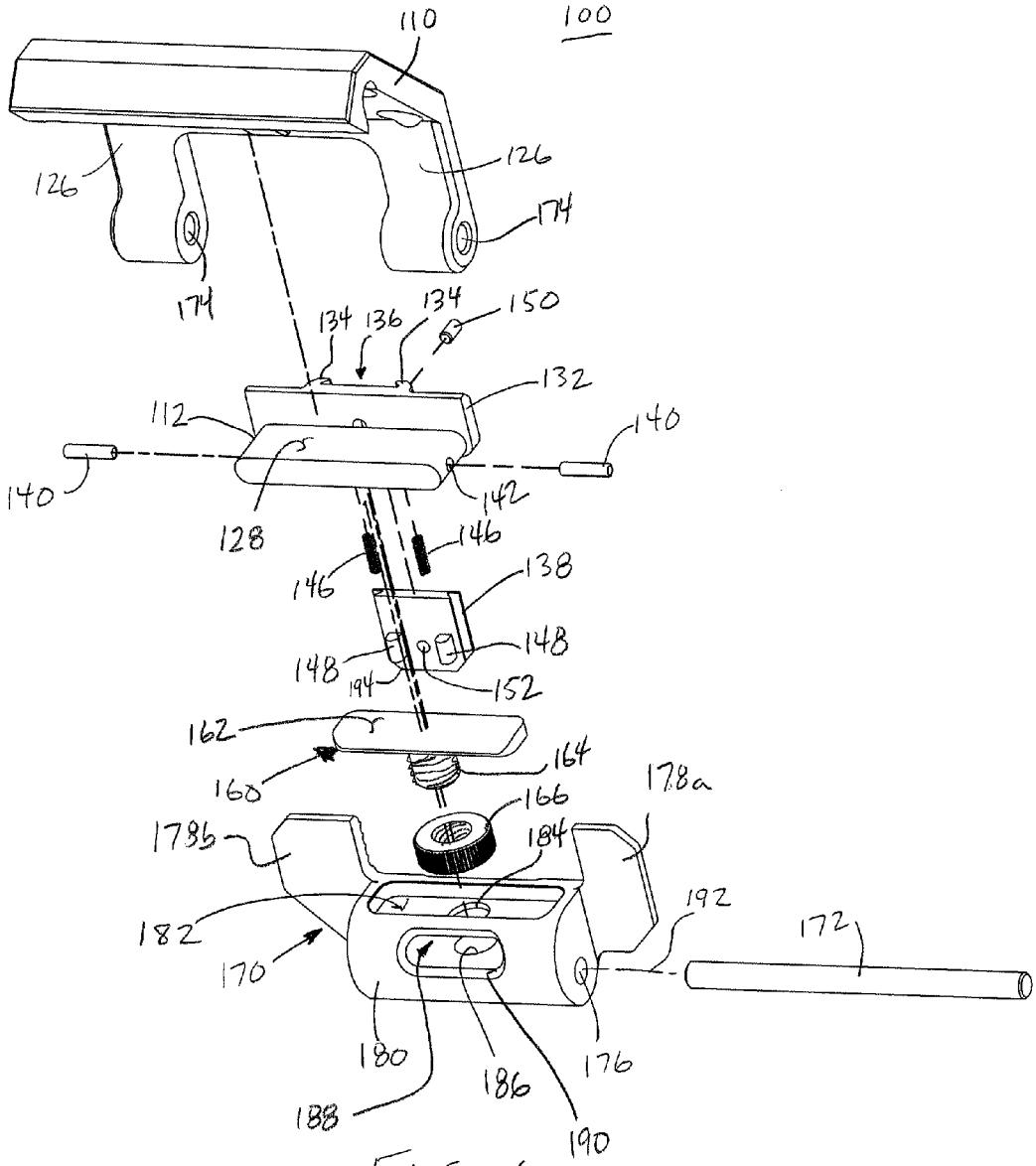
FIG. 6 is a generally interior facing exploded view of the clamp embodiment appearing in FIG. 1.

After the tab 138 is moved to the unlocked position wherein the lip 194 is clear of the cam member 170, the cam member 170 is manually pivoted from the closed position to the open position using the tabs 178*a* and/or 178*b*, at which time the unit 100 and any attached accessory device can be removed from the rail member 210. As can be seen in FIG. 4, the edges of the tabs 178*a* and/or 178*b* may protrude in the axial direction beyond the edges of the arms 126 to assist the user in manual rotation the cam member 170 after the tab 138 has been slid to the unlocked position.

To attach the unit 100, the above process is reversed. In the event adjustments need to be made to the clamping pressure exerted by the cam body 180 and the pressure plate 112, the nut 166, which is accessible through the window 190 when the unit 100 is removed from the rail member 210, is rotated in the desired direction to selectively make fine adjustments to the clamping pressure.

The invention has been described with reference to the preferred embodiments. Modifications and alterations will occur to others upon a reading and understanding of the preceding disclosure herein, whereby it is to be distinctly understood that the foregoing descriptive matter is to be interpreted merely as illustrative of the invention and not as a limitation.

What is claimed is:

1. A clamping device for a weapon accessory rail of a type having an elongate mounting structure of generally T-shaped cross-sectional shape, the clamping device comprising:

a mounting base including a first clamping surface for engaging a mounting surface of the mounting structure, said mounting base further including an outward facing surface opposite the first clamping surface for attaching an accessory device thereto and a hook disposed on a first transverse side of the mounting base, the hook configured to engage a first transverse side of the mounting structure;

a pressure plate slidable with respect to the mounting base, the pressure plate received between first and second arms, said first and second arms axially spaced apart and extending from the mounting base on a second transverse side of the mounting base opposite the first transverse side of the mounting base;

a cam member having a lever attached to a cam body, said cam body pivotally mounted between the first and second arms;

said cam body bearing against said pressure plate to cause sliding movement of the pressure plate in response to pivoting movement of said lever; and a locking tab slidably attached to the pressure plate, said locking tab slidable between a locked position and an unlocked position, the locking tab having a lip engaging the cam member to prevent pivoting movement of the cam body out of a clamped position when the locking tab is in the locked position.

2. The clamping device of claim 1, further comprising one or more tapped openings in the mounting base.

3. The clamping device of claim 1, further comprising:

said hook defining a second clamping surface for engaging an inclined surface on the first transverse side of the mounting structure; and said pressure plate defining a third clamping surface for engaging an inclined surface on a second transverse side of the mounting structure.

4. The clamping device of claim 3, further comprising:

said pressure plate configured to exert a clamping force in a direction orthogonal to the inclined surface on the second transverse side of the mounting structure.

5. The clamping device of claim 1, wherein a portion of the cam body is adjustable.

6. The clamping device of claim 1, further comprising:

a height adjustment member comprising a bearing surface engaging pressure plate when said clamping device is in the clamped position;

said height adjustment member further including a threaded shaft attached to the bearing surface and extending through an opening in the cam body; and a threaded nut rotatably engaging the threaded shaft, wherein rotation of the threaded nut in a first direction causes movement of the bearing surface toward the pressure plate and rotation of the threaded nut in a second direction causes movement of the bearing surface away from the pressure plate.

7. The clamping device of claim 1, wherein said threaded nut is received within a cavity formed in the cam body.

8. The clamping device of claim 1, further comprising:

one or more springs urging the locking tab toward the locked position.

9. The clamping device of claim 1, further comprising:

a protrusion formed on said first clamping surface, said protrusion being sized to engage a transverse channel in the mounting structure.

10. The clamping device of claim 1, wherein said outward facing surface is adapted for removably attaching the accessory device.

11. The clamping device of claim 1, wherein the mounting structure is a Picatinny rail.

* * * * *